US010914035B1

(12) United States Patent
Seymour et al.

(10) Patent No.: US 10,914,035 B1
(45) Date of Patent: Feb. 9, 2021

(54) THROUGH-AIR DRYING APPARATUS

(71) Applicant: Kimberly-Clark Worldwide, Inc., Neenah, WI (US)

(72) Inventors: Robert J. Seymour, Appleton, WI (US); Reza Ramazani-Rend, De Pere, WI (US); Daniel K. Lawson, Owensboro, KY (US); Kenneth J. Zwick, Neenah, WI (US); Peter J. Allen, Neenah, WI (US); Nathan J. Haiduk, Hortonville, WI (US); Robert E. Krautkramer, Combined Locks, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/621,304

(22) PCT Filed: Aug. 29, 2019

(86) PCT No.: PCT/US2019/048685

§ 371 (c)(1),
(2) Date: Dec. 11, 2019

(51) Int. Cl.
*D21F 5/18* (2006.01)
*F26B 13/24* (2006.01)
*F26B 13/16* (2006.01)

(52) U.S. Cl.
CPC ..... *D21F 5/182* (2013.01); *F26B 13/16* (2013.01); *F26B 13/24* (2013.01)

(58) Field of Classification Search
CPC ..... D21F 5/182; D21F 5/184; D21F 11/145; D21F 5/044; F26B 13/16; F16J 15/16; F16J 15/34
See application file for complete search history.

(56) References Cited

U.S. PATENT DOCUMENTS 2,517,470 A * 8/1950 Erisman ..... F26B 11/024 285/9.2
3,432,936 A 3/1969 Cole et al.
(Continued)

FOREIGN PATENT DOCUMENTS

DE 102004017812 A1 11/2005
DE 102004017819 A1 11/2005
(Continued)

OTHER PUBLICATIONS

The Tissue Story, "Through Air Drying (TAD) tissue making technology", http://www.tissuestory.com/2017/09/28/through-air-drying-tad-tissue-making-technology\, May 25, 2018.

*Primary Examiner* — Eric Hug
(74) *Attorney, Agent, or Firm* — Kimberly-Clark Worldwide, Inc.

(57) ABSTRACT

The disclosure is directed towards a through-air drying system comprising a hood and a rotatable cylinder with a porous cylindrical deck. The system includes a seal, and more particularly a seal along the lateral edges of the system. The seal generally prevents the exhaust of drying medium from the system through the gap between the hood and the rotatable cylinder and enables the system to be operated at positive air pressure. The seal may be formed by providing the hood with an axial hood flange, which extends at least partially along the bottom edge of the hood and overlaps an axial annular flange disposed on the cylinder when the hood is in a closed and sealed position.

27 Claims, 3 Drawing Sheets

(56) References Cited

U.S. PATENT DOCUMENTS

| | | | | | |
|---|---|---|---|---|---|
| 3,771,236 | A | * | 11/1973 | Candor | F26B 13/16 34/452 |
| 3,852,892 | A | | 12/1974 | Sheehan | |
| 4,199,155 | A | * | 4/1980 | Day | F16J 15/3436 277/377 |
| 4,974,340 | A | | 12/1990 | Wedel et al. | |
| 6,080,279 | A | | 6/2000 | Hada et al. | |
| 6,199,296 | B1 | | 3/2001 | Jewitt | |
| 6,306,258 | B1 | | 10/2001 | Lange et al. | |
| 6,331,230 | B1 | | 12/2001 | Hermans et al. | |
| 6,921,460 | B2 | | 7/2005 | Hermans et al. | |
| 7,040,038 | B1 | | 5/2006 | Beaumont | |
| 7,841,103 | B2 | | 11/2010 | Hada et al. | |
| 2005/0204581 | A1 | | 9/2005 | Jewitt | |
| 2009/0211723 | A1 | | 8/2009 | Attwenger | |

FOREIGN PATENT DOCUMENTS

| | | | |
|---|---|---|---|
| DE | 102009000371 | A1 | 8/2010 |
| GB | 773908 | A | 5/1957 |

* cited by examiner

THROUGH-AIR DRYING APPARATUS

BACKGROUND

In the manufacture of high-bulk tissue products, such as facial tissue, bath tissue, paper towels, and the like, it is common to use one or more through-air dryers for partially drying the web or to bring the tissue web to a final dryness or near-final dryness. Through-air dryers typically include a rotating cylinder having an upper deck that supports a drying fabric which, in-turn, supports the web being dried. Heated air is passed through the web in order to dry the web. For example, in one embodiment, heated air is provided by a hood, which is generally retractable, above the drying cylinder. Alternatively, heated air is provided to a center area of the drying cylinder and passed through to the hood.

When incorporated into a papermaking system, through-air dryers offer many and various benefits and advantages. For example, through-air dryers are capable of drying tissue webs without compressing the web. Thus, moisture is removed from the webs without the webs losing a substantial amount of bulk or caliber. In fact, through-air dryers, in some applications, may even serve to increase the bulk of the web. Through-air dryers are also known to contribute to various other important properties and characteristics of the webs.

Commonly through-air dryers are equipped with a vacuum system that may be operated to maintain a neutral air pressure along the gap formed between the retractable hood and the drying cylinder. If this pressure becomes negative, cold machine room air may be drawn through the hood/drying cylinder gap and drying may be negatively affected. It is difficult, however, to maintain a neutral pressure over the entire width of the through-air dryer because the air permeability of the sheet changes as it dries. Thus, in practice, it is common to operate the system with a positive air pressure. Operating with positive air pressure however, increases the amount of heated air that escapes through the hood/drying cylinder gap, which may represent a significant loss of energy and may cause heating of the machine room and make it uncomfortable to work near the dryer.

Several sealing means have been proposed to address the problem of heated air escaping from an enclosed dryer. For example, GB Publication No. 773,908 suggests installing skirts extending downwardly from a hood and beyond the rotating dryer. In other instances, the skirts may extend short of the dryer and be provided with a piece of flexible material, such as felt, which may contact the dryer to form a seal. Forming a seal between the dryer surface and the hood in this manner however, is complicated by thermal expansion of the components during startup of the dryer.

In other instances, to prevent heated air from exiting the hood/drying cylinder gap a thin Teflon strip may be installed on the edge of the retractable hood. This approach however, is also complicated by thermal expansion of both the drying cylinder and the hood, making it difficult to properly size the strip and seal the gap.

In still other instances, such as that described in U.S. Pat. No. 3,432,936, the hood is sealed at its side edges adjacent the surface of the cylinder by providing a raised portion or strip extending around the outside surface of the cylinder. A seal strip made of a resilient material, such as rubber or plastic, is bolted to the lower end of an outer sidewall of the hood and arranged to ride in sealing contact with the strip on the surface of the cylinder. The '936 patent further describes introduction of a second airstream into an outer portion of the hood to seal the hood and prevent leakage. This sealing arrangement is also complicated by thermal expansion of the hood and dryer and involves operating a second air system, which adds costs and complicates operation.

Thus, there remains a need in the art for a sealing mechanism that effectively seals the hood/drying cylinder gap, prevents the loss of heated air when the dryer is operated at positive air pressure and is effective over a range of dryer temperatures.

SUMMARY

It has now been discovered that a through-air drying system comprising a hood and a rotatable cylinder with a porous cylindrical deck may be operated at positive air pressure by providing the system with a seal and more particularly a seal along the lateral edges of the system. The seal generally prevents the exhaust of drying medium from the system through the gap between the hood and the rotatable cylinder. The seal may be formed by providing the hood with an axial hood flange, which extends at least partially along the bottom edge of the hood and overlaps an axial annular flange disposed on the cylinder when the hood is in a closed and sealed position.

Accordingly, in one embodiment the present invention provides a through-air drying apparatus having longitudinal, transverse and axial directions comprising: a rotatable cylinder having a pair of spaced apart headers; an annular flange attached to each of the pair of spaced apart headers and extending axially therefrom; a hood having a pair of spaced apart sidewalls terminating at bottom sidewall edges, the hood movable between an open and closed position for interacting with and covering at least a portion of the rotatable cylinder; a hood flange having a substantially axially extending portion attached to the sidewall and a substantially longitudinally extending portion; wherein the annular flange and the hood flange cooperate with one another when the hood is in a closed position to form a substantially sealed enclosure containing the rotatable cylinder.

In another embodiment the present invention provides a through-air drying apparatus having longitudinal, transverse and axial directions comprising: a rotatable cylinder having a porous cylindrical deck and a pair of spaced apart headers; an annular flange attached to each of the pair of spaced apart headers and extending axially therefrom; a hood having a pair of spaced apart sidewalls terminating at bottom sidewall edges and being operable for passing drying air between an interior of the hood and an interior of the rotatable cylinder, the hood movable between an open and closed position for interacting with and covering at least a portion of the rotatable cylinder; a hood flange having a substantially axially extending portion attached to the sidewall and a substantially longitudinally extending portion; wherein the annular flange and the hood flange cooperate with one another when the hood is in a closed position to form a substantially sealed enclosure containing the rotatable cylinder.

In still another embodiment the present invention provides a system for enclosing a through-air dryer having a rotatable cylinder with a porous cylindrical deck and having at least one continuous drying fabric wrapped about a portion of the circumference thereof adapted to transport a wet paper web thereabout, the system comprising: an annular flange extending axially from the cylinder; a hood for covering the portion of the cylinder about which the fabric and the web are wrapped, the hood being operable for passing drying air between the interior of the hood and the interior of the cylinder; and a hood flange having an axially extending portion and a longitudinally extending portion, wherein the longitudinally extending portion of the hood flange overlaps at least a portion of the annular flange.

In yet other embodiments the present invention provides a method of through-air drying a tissue web comprising the steps of transferring a partially dewatered fibrous web to a through-air drying fabric, transporting the through-air drying fabric and partially dewatered fibrous web over a drying cylinder having an annular flange extending axially therefrom, providing a hood that engages with and at least partially encloses the drying cylinder, the hood having a longitudinally extending portion that overlaps the annular flange to form a seal therebetween, and pressurizing the hood with heated air. In certain instances, the seal formed by overlapping the longitudinally extending portion of the hood and the axially extending dryer flange enables the through-air drying system to be operated at a positive pressure, such as a pressure from about 3,000 to about 7,000 pascals.

DETAILED DESCRIPTION

Figure 1:
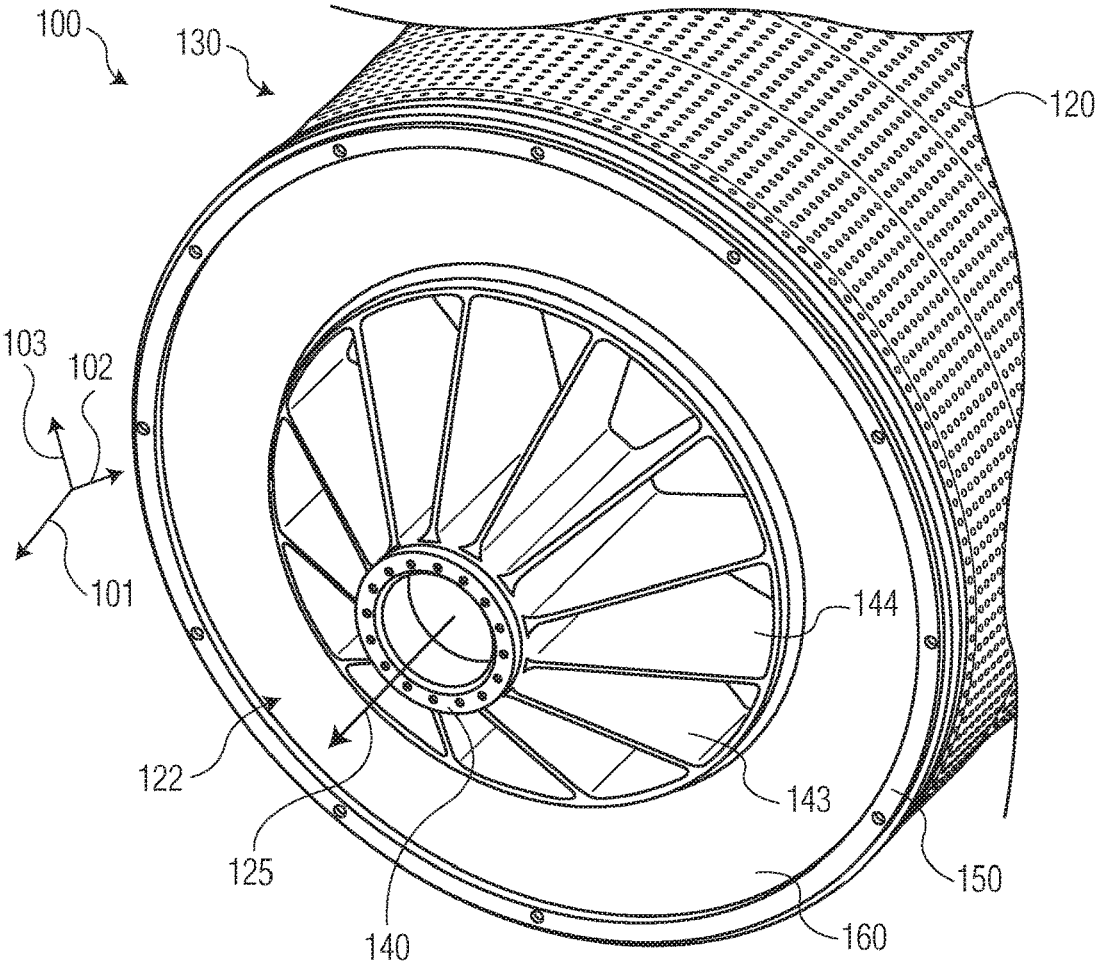
FIG. 1 is a perspective view of a cylindrical dryer.

The sealed through-air drying system of the present invention is well suited for drying of a wide variety of web materials, particularly fibrous webs and more particularly fibrous tissue webs that may be converted into tissue products such as such as facial tissue, bath tissue, paper towels, and the like. In certain instances, a partially dewatered web, such as a fibrous tissue web, is transferred to a through-air drying fabric and carried around a cylindrical deck of a pressurized through-air dryer system generally made in accordance with the present invention. The through-air dryer system generally includes a retractable hood and a drying cylinder. A drying medium such as a heated gas, and more particularly heated air, is introduced to the system and used to dry the web as it is transported along the drying cylinder.

In certain instances, a burner may be used to heat ambient air, which may then be forced by a fan into the hood. The hood, in-turn, directs the heated air through the web carried on the through-air drying fabric. The heated air is drawn through the web, drying the web, and through the surface of the drying cylinder. In certain embodiments at least a portion of the hot air is re-circulated back to the burner using a fan. In one embodiment, in order to avoid the build-up of moisture in the system, a portion of the spent heated air is vented, while a proportionate amount of fresh make-up air is fed to the burner.

While in certain embodiments heated air travels from the hood through the tissue web and then through the drying cylinder, the invention is not so limited. In other embodiments, the heated air may be fed through the drying cylinder and then forced into the hood. Regardless of the direction of air flow in the through-air dryer, heated air is passed through the tissue web as it is supported by a through-air drying fabric to dry the web.

The through-air drying system of the present invention is provided with a seal and more particularly a seal along the lateral edges of the system. The seal generally prevents the exhaust of drying medium from the system through the gap between the hood and the rotatable cylinder, which gap generally extends longitudinally along the lateral edge of the system. The seal may be formed by providing the hood with an axially extending hood flange, which extends at least partially along the bottom edge of the hood and overlaps an axially extending annular flange disposed on the cylinder when the hood is in a closed and sealed position.

In certain instances, the seal is configured to reduce the gap width, the transverse distance between the cylinder flange and the hood flange, and increase the gap length, the axial length between seal and the cylinder head. By reducing the gap width and increasing the gap length the area that heated air may exit the system may be reduced while also reducing the discharge coefficient and velocity of the exiting air. For example, the sealing mechanism may reduce the gap width to less than about 1.00 cm, such as less than about 0.50 cm, and more preferably less than about 0.125 cm, such as from about 0.125 to about 1.00 cm. In other instances, the sealing mechanism may increase the gap length to greater than about 4.0 cm, such as greater than about 5.0 cm. In this manner the seal may decrease the gap area and decrease the discharge coefficient of heated air to improve operation of the system under positive air pressures, such as pressures from about 3,000 to about 7,000 pascals.

With reference to FIG. 1, the first end 122 of a through-air drying cylinder 100 useful in the present invention is illustrated. The through-air drying cylinder 100 comprises a rotatable drying cylinder, also referred to herein simply as a dryer, having an axial 101, transverse 102 and longitudinal 103 direction. The dryer 100 comprises a cylindrical deck 120, which forms the outer most surface 130 of the dryer 100. In use the cylindrical deck may support a through-air drying fabric, which in-turn, may support a web to be dried by the through-air drying apparatus.

The drying cylinder may comprise a stationary support shaft, or journal, that is concentrically positioned with respect to the cylindrical deck. The shaft may extend from a first side or end of the drying cylinder to a second and opposite side. The cylindrical deck is intended to rotate about the shaft's central axis 125.

In certain instances, a pair of journals may extend axially outwardly from either end of the cylindrical dryer and be carried by a pair of journal bearings. In certain instances, the journal may extend beyond the bearing and carry a seal bearing on its outermost end. Generally, the journal, and any extending portion, are hollow and allow the passage of fluids from the interior of the cylindrical shell therethrough. A duct member may be attached to the seal bearing and connected to a vacuum source. In this manner, air passing through the web carried on the surface of the dryer is withdrawn from the interior of the deck through the passage in the journal and out through the duct.

With continued reference to FIG. 1, the through-air drying cylinder 100 may comprise a hub 140 connected to the cylindrical deck 120 by a support structure 143. In this manner the hub 140 may be attached to the cylindrical deck 120 and both may be rotatable about a central axis 125. In certain preferred embodiments the hub may extend continuously from a first end 122 to a second end and includes passages for permitting air flow therethrough. The support structure 143 may include a hub 140 and a plurality of spokes 144.

In other embodiments the drying cylinder may include various other internal components that assist in supporting the cylindrical deck. For instance, the drying cylinder may include a tube disposed over the hub, internal support members, or a deck support ring, that all rotate with the cylindrical deck. The internal support members may be attached to the rotating tube on one end and to the deck support ring on an opposite end. In this manner, the deck support ring may support the cylindrical deck at a mid region between each end of the cylindrical deck. The internal support members can be in the shape of plates and can assist in directing air flow through the dryer. The internal support members may be of a single piece construction or may be of a multi-piece construction as desired.

The cylindrical deck may be made from a single piece of welded steel having a honeycombed structure providing high structural strength while having a high amount of open area to permit air flow therethrough, or it may comprise a plurality of individual plates. In those embodiments where the deck comprises a plurality of plates, the plates may be connected to the deck support ring in a manner that allows thermal expansion. For instance, in one embodiment, each plate may include an indentation into which the deck support ring is received. In this manner, the plates may move relative to the deck support ring while remaining supported by the deck support ring.

Figure 2:
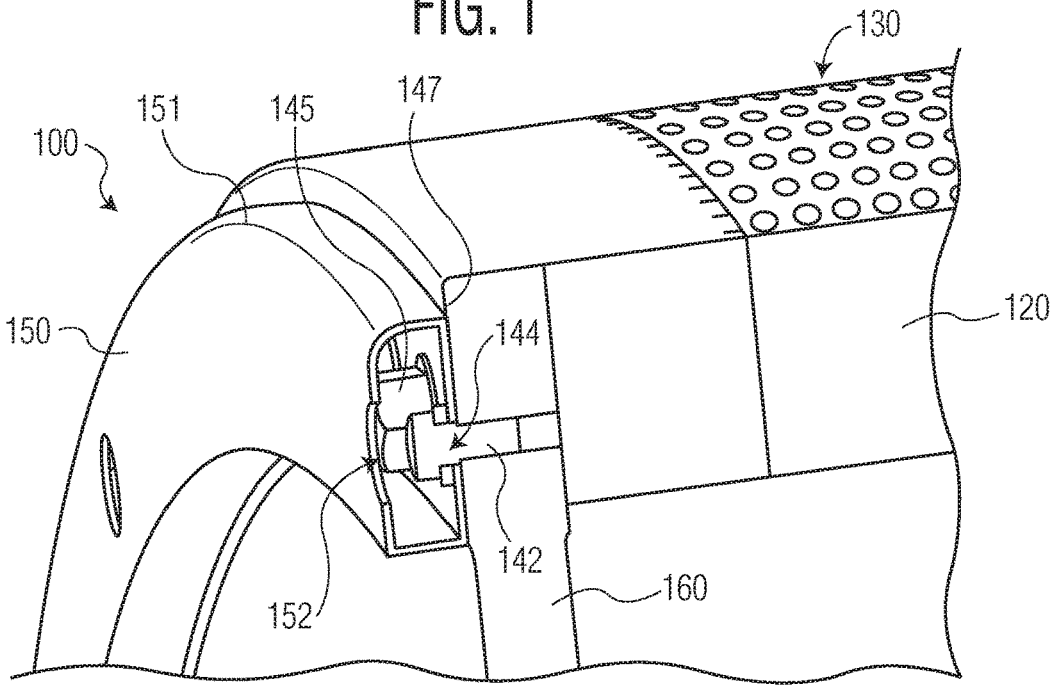
FIG. 2 is a cross-sectional view of a cylindrical dryer.

With reference to FIGS. 1 and 2, the cylindrical deck 120 is generally connected to a pair of spaced apart headers 160, which are in-turn connect to the hub 140 by the support structure 143. In this manner the pair of spaced apart headers 160 form a portion of the first 122 and second ends of the drying cylinder 100. The header 160 may be fastened to the cylindrical deck 120 by a plurality of bolts 145 (shown in FIG. 2) spaced about the header 160 near its peripheral edge 147.

An annular flange 150, which forms a portion of the inventive sealing mechanism, is attached to the header 160 near the header outer peripheral edge 147. The annular flange 150 extends axially outwardly from the header 160 and forms a portion of the dryer first end 122. The annular flange 150 generally comprises an axially extending portion 151 and a longitudinally extending portion 152. The distance that the axially extending portion extends from the header may be adjusted to achieve the desired reduction in the discharge coefficient and velocity of heated air exiting the system.

In certain embodiments, such as that illustrated in FIG. 2, the annular flange 150 may be a closed annular member having a substantially D-shaped cross-sectional configuration. The cross-sectional shape is closed despite having apertures through which a bolt may be inserted to secure the flange to the dryer head.

While annular flanges having a closed D-shape may be preferred, the invention is not so limited and one skilled in the art will appreciate that other cross-section shapes, including both closed loop and open, may be used. For example, in other embodiments the annular flange may comprise an open U-shaped structure.

Regardless of the shape of the annular flange it is generally preferred that it be attached to the header and more preferably attached near the outer peripheral edge of the header. One means of attaching the annular flange to the header is illustrated in detail in FIG. 2. In the illustrated embodiment, a bolt 142 is used to attach the annular flange 150 to the header 160. The bolt 142 passes through an inner aperture 141 of the annular flange 150 and is fastened to the header 160. The bolt 142 may be accessed by an outer aperture 152 of the annular flange 150.

Figure 3:
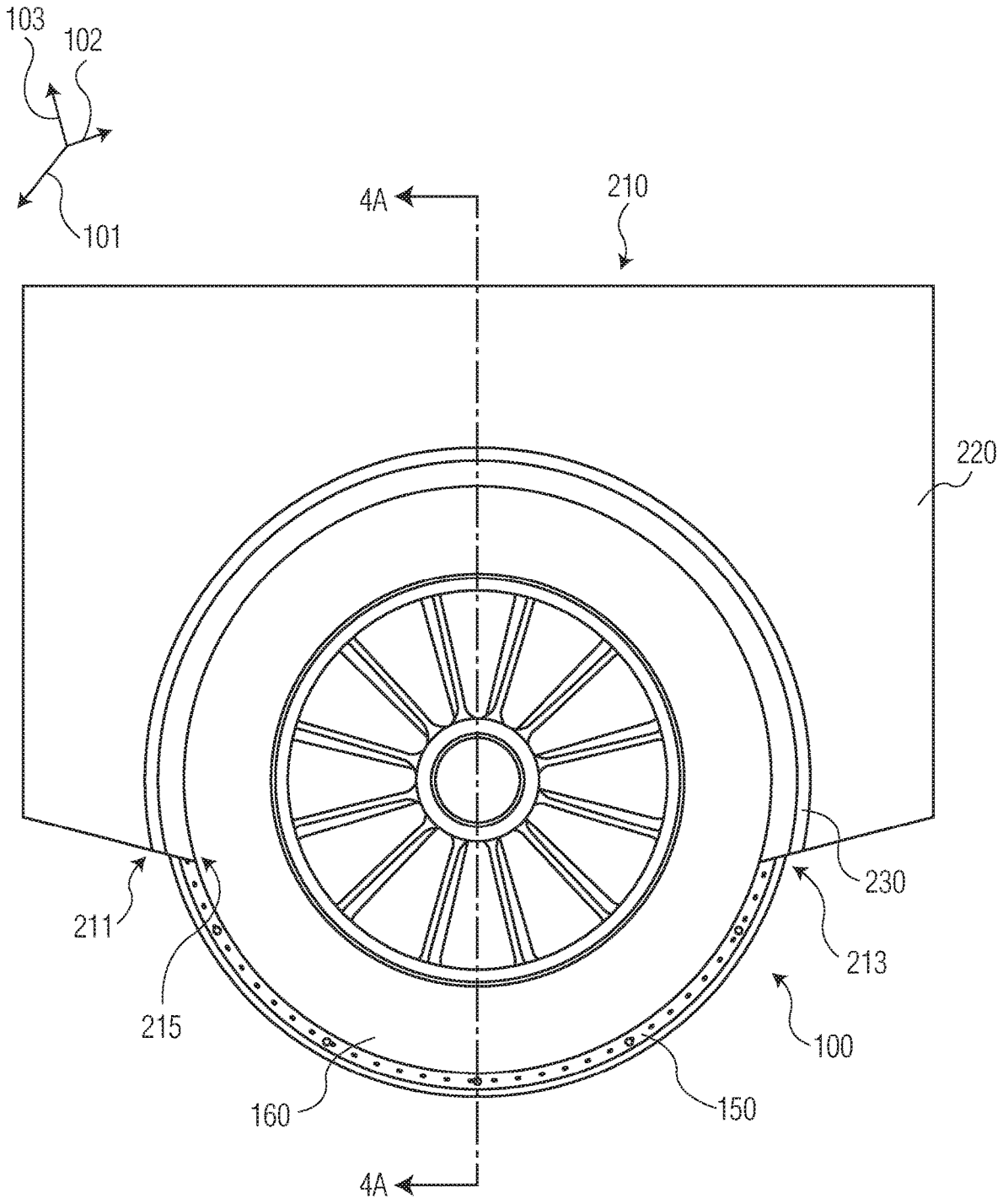
FIG. 3 is a side view of a through-air drying apparatus.

With reference now to FIG. 3, in operation the through-air dryer generally requires a means for directing the drying medium through the paper web to perform the desired drying. To that end, a hood 210 is typically provided to cover a portion of the dryer 100. Preferably, the hood 210 at least partially covers the drying cylinder 100 and extends from an upstream end 211 to a downstream end 213. In particularly preferred embodiments, the hood may be configured to cover the portion of the dryer about which the through-air drying fabric and the web are wrapped. Where the drying section of a paper machine includes more than one drying cylinder, each drying cylinder may be provided with an individual hood, or a common hood may cover two or more cylinders.

The hood 210 may comprise a sidewall 220, preferably a unitary piece of longitudinally extending metal as illustrated in FIG. 3 or may be constructed from multiple pieces. Regardless of the manner of construction it is generally preferable that the hood be moveable between a closed, sealed, position and an open, unsealed position. In this manner the hood may be retracted when not in use to permit access to the drying cylinder and the through-air drying fabric. When in operation the hood maybe lowered into a closed, sealed position, such as illustrated in FIG. 3, to prevent the exhaust of drying medium from the portion of the through-air dryer where the hood covers the drying cylinder.

The extent to which the hood covers the drying cylinder when in a closed, sealed position may vary. In certain instances, the hood only partially covers the cylinder when the hood is in a closed position. More particularly the arc length of the drying cylinder covered by the hood may range from about 30 to about 60 percent of the perimeter length of the cylinder, such as from about 45 to about 55 percent.

In certain embodiments the hood may contain interior partitions to control the flow and the distribution of the drying medium. Further, depending on the configuration used, the hood may be operably arranged to provide the drying medium to the drying cylinders or to exhaust the drying medium therefrom. Accordingly, where the hood supplies the drying medium, it is configured such that the drying medium is directed through the web and the fabric about the cylinders.

To prevent the exhaust of drying medium from the portion of the through-air dryer system where the hood covers the drying cylinder, an edge seal according to the present invention is provided. The edge seal 215 comprises a hood flange 230 attached to and extending outwardly from the hood sidewall 220 in an axial direction and the annular flange 150, which is fastened to the header 160. When the hood 210 is in a closed position the hood flange 230 and annular flange 150 cooperate with one another to seal the through-air drying system and prevent the drying medium from exiting along its lateral edges.

Figure 4A:
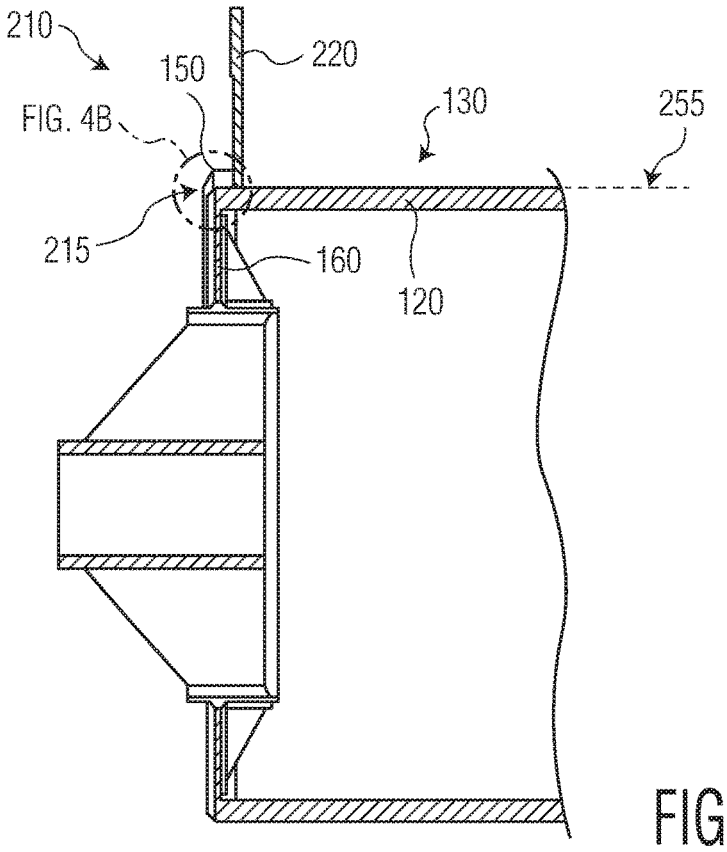
FIGS. 4A and 4B are cross-sectional views of a through-air drying apparatus.
Figure 4B:
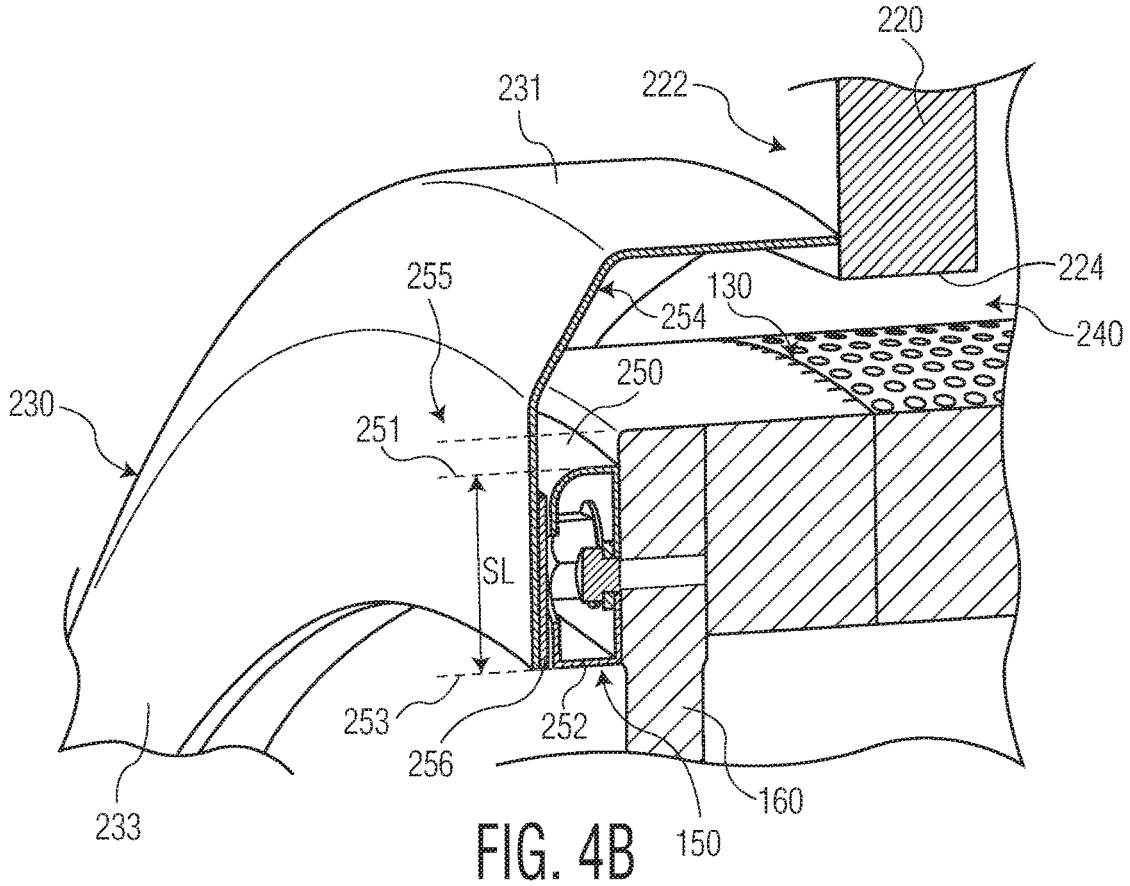

With reference now to FIGS. 4A and 4B, which show the hood 210 in a closed position and forming an edge seal 215. The edge seal 215, which is generally defined by the overlap between the hood flange 230 and the annular flange 150 has an upper portion 250 lying in a first transverse plane 251 and a lower portion 252 lying in a second transverse plane 253. In certain preferred embodiments the first transverse plane 251 is below the dryer surface plane 255. Further, the edge seal 215 has an edge seal length (SL) generally measured between the upper most or lower most portions 250, 252 of the hood flange/annular flange overlap when the hood 210 is in a closed and sealed position. In certain instances, the edge seal length (SL) may range from about 2.0 to about 10.0 cm, such as from about 4.0 to about 6.0 cm.

The hood flange 230 is generally attached to the outer surface 222 of the hood sidewall 220 near its low edge 224

(shown in detail in FIG. 4B). The hood flange 230 extends generally in an axial direction outwardly from the sidewall 220. The hood flange may extend along the entire length of the sidewall bottom edge or may extend along only a portion of its length. In a particularly preferred embodiment, the length of the hood flange is equal to the arc length of the cylinder covered by the hood when the hood is in a closed and sealed position.

In certain preferred embodiments the hood flange 230 is generally L-shaped and comprises an axially extending portion 231 attached to, and extending axially outward from, the hood sidewall 220. The hood flange 230 also comprises a longitudinally extending portion 233 that extends generally downwardly from the axial portion 231 and terminates at a flange bottom edge 235.

In the embodiment illustrated in FIGS. 4A and 4B it is generally preferred that the bottom portion of the hood flange 230 be open and shaped to receive the annular flange 150. Accordingly, when the hood is in a closed position the longitudinally extending portion 233 of the hood flange 230 extends beyond at least a portion of the annular flange 150. In a particularly preferred embodiment, the longitudinally extending portion 233 extends along the entire longitudinal dimension of the annular flange 150 when the hood is in a closed and sealed position. In still other embodiments, the longitudinally extending portion extends beyond the annular flange when the hood is in a closed and sealed position.

In certain instances, the length of the longitudinally extending portion of the hood flange is substantially uniform along its entire length. In other instances, the length of the longitudinally extending portion of the hood flange varies along its entire length. For example, the length of the longitudinally extending portion of the hood flange may be greater at a first end of the flange compared to near the midpoint of the flange. In certain instances, it may be necessary for both the first and second ends of the hood flange to have longer longitudinally extending portions, compared to a point near the middle of the flange, to account for deflection of the hood sidewall in operation and form an operable seal.

Regardless of the degree of overlap between the hood flange 230 and the annular flange 150, it is generally preferred that a seal 215 is formed out of plane with the dryer surface plane 255. For example, as illustrated in FIG. 4A, the dryer upper surface 130 lies in a surface plane 255. The seal 215, which is generally defined as the overlap portion of the hood flange 230 and the annular flange 150 has an upper portion 250 lying in a first transverse plane 251 that is below the dryer surface plane 255.

Not only is it desirable to form the seal out-of-plane with the dryer surface 130, it is generally preferred that the seal 215 be formed outboard, positioned axially outward, of the header 160 to seal the gap 240 between the hood sidewall 220 and the dryer surface 130. In this manner, as illustrated in FIG. 4B, the seal 215 may be formed axially outward from both the header 160 and the hood sidewall 220. Further, it is generally preferred to achieve the seal 215 without extending the dryer surface 130 beyond the header 160, as illustrated in FIG. 4B.

In certain instances, a slight longitudinally orientated gap, such as less than about 1.00 cm and more preferably less than about 0.5 cm, such as from about 0.10 to about 1.00 cm, is formed along the overlapped portions of the hood flange 230 and the annular flange 150. Despite this longitudinally orientated gap, the system may be sealed as a result of the gap being moved axially outward and reduced in size relative to the gap between the hood sidewall and the deck of the drying cylinder.

In certain instances, to avoid contact between the hood flange 230 and the annular flange 150, a wear resistant material 256 may be attached inside the face 254 of the hood flange 230. Suitable wear resistant materials include, for example, non-metallic materials such as polyetheretherketone (PEEK), polyetherketone (PEK), polyetherketoneetherketoneketone (PEKEKK), and polyetheretherketoneketone (PEEKK), and generally a polyaryletheretherketone. Further other polyketones can be used as well as other thermoplastics. Other suitable wear resistant materials include, for example, silicone rubber or Teflon.

In operation, the hood 210 is lowered over the cylindrical dryer 100 and the hood flange 230 overlaps the annular flange 150 along a portion of the dryer's circumference to form an edge seal 215. A drying medium is introduced to the hood 210 at a pressure in excess of atmospheric pressure and the cylindrical dryer 100 is rotated. The hood 210 and hood flange 230 remain in a fixed position, while the annular flange 150 rotates with the dryer 100. The edge seal 215 prevents the pressurized drying medium from exiting the dryer along its lateral edge.

Generally, a wet paper web, such as a tissue web, is transported on a through-air drying fabric, which may be a continuous belt of porous construction forming a loop around the cylindrical dryer. The drying cylinder and fabric may be arranged such that the fabric is wrapped about a major portion of the circumference of the dryer. In addition to the cylindrical dryer, the through-air drying fabric may loop one or more fabric supports that may include, for example, a vacuum box, a rotatable roll, or the like. As the wet paper web is transported across the drying cylinder by the through-air drying fabric, the drying medium, which may be a heated gas such as air, or a hot vapor such as steam, passes through the web using applied differential pressure. Water is then removed from the web by the drying medium principally by the mechanism of forced convection.

In view of the foregoing description, it will be apparent to one of ordinary skill in the art that the following embodiments are within the scope of the present invention:

In a first embodiment the invention provides a through-air drying apparatus having longitudinal, transverse and axial directions comprising a rotatable cylinder having a porous cylindrical deck and a pair of spaced apart headers; an annular flange attached to each of the pair of spaced apart headers and extending axially therefrom; a hood having a pair of spaced apart sidewalls terminating at bottom sidewall edges and being operable for passing drying air between an interior of the hood and an interior of the cylinder, the hood movable between an open and closed position for interacting with and covering at least a portion of the cylinder; a hood flange having a substantially axially extending portion attached to the sidewall and a substantially longitudinally extending portion; wherein the annular flange and the hood flange cooperate with one another when the hood is in a closed position to form a seal.

In a second embodiment the invention provides the invention of the first embodiment wherein the longitudinally extending portion of the hood flange extends beyond the sidewall bottom edge.

In a third embodiment the invention provides the invention of either of the first or the second embodiments wherein the annular flange has a bottom edge portion lying in a first transverse plane and the vertical portion of the hood flange has a bottom edge lying in a second transverse plane when the hood is in a closed position and wherein the first and second transverse planes lie substantially in the same plane.

In a fourth embodiment the invention provides the invention of any one of the first through third embodiments wherein the annular flange has a bottom edge portion lying in a first transverse plane and the vertical portion of the hood flange has a bottom edge lying in a second transverse plane when the hood is in a closed position and wherein the first transverse plane lies above the second transverse plane.

In a fifth embodiment the invention provides the invention any one of the first through fourth embodiments wherein the annular flange has a closed D-shape and the hood flange has an open L-shape.

In a sixth embodiment the invention provides the invention of any one of the first through fifth embodiments further comprising a wear resistant nonmetallic material disposed on the vertical portion of the hood flange. In certain embodiments the non-metallic material may be selected from the group consisting of polyetheretherketone (PEEK), polyetherketone (PEK), polyetherketoneetherketoneketone (PEKEKK), and polyetheretherketoneketone (PEEKK), and generally a polyaryletheretherketone. Further other polyketones can be used as well as other thermoplastics. Other suitable wear resistant materials include, for example, silicone rubber and Teflon In a seventh embodiment the invention provides the invention of any one of the first through sixth embodiments wherein the hood only partially covers the cylinder when the hood is in a closed position.

In an eighth embodiment the invention provides the invention of any one of the first through seventh embodiments wherein the arc length of the cylinder covered by the hood ranges from about 30 to about 60 percent of the perimeter length of the cylinder.

In a ninth embodiment the invention provides the invention of any one of the first through eighth embodiments wherein the length of the hood flange is equal to the arc length of the cylinder covered by the hood.

In a tenth embodiment the invention provides the invention of any one of the first through ninth embodiments wherein the length of the longitudinally extending portion of the hood flange is substantially uniform along the entire length of the hood flange.

In an eleventh embodiment the invention provides the invention of any one of the first through tenth embodiments wherein the length of the longitudinally extending portion of the hood flange varies along the length of the hood flange.

What is claimed is:

1. A through-air drying apparatus having longitudinal, transverse and axial directions comprising:

a rotatable cylinder having a porous cylindrical deck and a pair of spaced apart headers;

an annular flange attached to each of the pair of spaced apart headers and extending axially therefrom;

a hood having a pair of spaced apart sidewalls terminating at bottom sidewall edges and being operable for passing drying air between an interior of the hood and an interior of the cylinder, the hood movable between an open and closed position for interacting with and covering at least a portion of the cylinder; and a hood flange having a substantially axially extending portion attached to the sidewall and a substantially longitudinally extending portion that extends beyond the sidewall bottom edge;

wherein the annular flange and the hood flange cooperate with one another when the hood is in a closed position to form a seal.

2. The apparatus of claim 1 wherein the annular flange has a bottom edge portion lying in a first transverse plane and the substantially axially extending portion of the hood flange has a bottom edge lying in a second transverse plane when the hood is in a closed position and wherein the first and second transverse planes lie substantially in the same plane.

3. The apparatus of claim 1 wherein the annular flange has a bottom edge portion lying in a first transverse plane and the substantially axially extending portion of the hood flange has a bottom edge lying in a second transverse plane when the hood is in a closed position and wherein the first transverse plane lies above the second transverse plane.

4. The apparatus of claim 1 wherein the annular flange has a closed D-shape and the hood flange has an open L-shape.

5. The apparatus of claim 1 further comprising a wear resistant nonmetallic material disposed on the substantially axially extending portion of the hood flange.

6. The apparatus of claim 1 wherein the hood only partially covers the cylinder when the hood is in a closed position.

7. The apparatus of claim 6 wherein the arc length of the cylinder covered by the hood ranges from about 30 to about 60 percent of the perimeter length of the cylinder.

8. The apparatus of claim 7 wherein the radial length of hood flange is equal to the arc length of the cylinder covered by the hood.

9. The apparatus of claim 1 wherein the length of the longitudinally extending portion of the hood flange is substantially uniform along the entire radial length of the hood flange.

10. The apparatus of claim 1 wherein the length of the longitudinally extending portion of the hood flange varies along the radial length of the hood flange.

11. The apparatus of claim 1 comprising a single rotatable cylinder.

12. The apparatus of claim 1 comprising a pair of rotatable cylinders.

13. A dryer for drying a wet web of paper in a paper making machine comprising:

a rotatable cylinder having a porous cylindrical deck and a pair of spaced apart headers;

an annular flange attached to each of the pair of spaced apart headers and extending axially therefrom;

at least one continuous drying fabric wrapped about a portion of the circumference of the deck for transporting a web thereabout with the web supported on a surface of the fabric;

a hood interacting with and covering a portion of the cylinder about which the fabric and the web are wrapped, the hood being operable for passing drying air between the interior of the hood and the interior of the cylinder and movable between an open and closed position; and a hood flange having a substantially axially extending portion attached to the hood and a substantially longitudinally extending portion that extends beyond the sidewall bottom edge;

wherein the annular flange and the hood flange cooperate with one another when the hood is in a closed position to form a seal.

14. The dryer of claim 13 wherein the annular flange has a bottom edge portion lying in a first transverse plane and the substantially axially extending portion of the hood flange has a bottom edge lying in a second transverse plane when the hood is in a closed position and wherein the first and second transverse planes lie substantially in the same plane.

15. The dryer of claim 13 wherein the annular flange has a bottom edge portion lying in a first transverse plane and the substantially axially extending portion of the hood flange has a bottom edge lying in a second transverse plane when the hood is in a closed position and wherein the first transverse plane lies above the second transverse plane.

16. The dryer of claim 13 wherein the annular flange has a closed D-shape and the hood flange has an open L-shape.

17. The dryer of claim 13 further comprising a wear resistant nonmetallic material disposed on the substantially axially extending portion of the hood flange.

18. The dryer of claim 13 wherein the cylinder has a perimeter length and wherein the hood covers from about 30 to about 60 percent of the perimeter length of the cylinder when the hood is in a closed position to form a seal.

19. The dryer of claim 13 wherein the length of the longitudinally extending portion of the hood flange is substantially uniform along the entire radial length of the hood flange.

20. The dryer of claim 13 wherein the length of the longitudinally extending portion of the hood flange varies along the length of the radial hood flange.

21. A system for enclosing a through-air dryer having a rotatable cylinder with a porous cylindrical deck and having at least one continuous drying fabric wrapped about a portion of the circumference thereof adapted to transport a wet paper web thereabout, the system comprising:

a closed D-shaped annular flange extending axially from the cylinder;

a hood for covering the portion of the cylinder about which the fabric and the web are wrapped, the hood being operable for passing drying air between the interior of the hood and the interior of the cylinder; and an open L-shaped hood flange having an axially extending portion and a longitudinally extending portion, wherein the longitudinally extending portion of the hood flange overlaps at least a portion of the annular flange.

22. The system of claim 21 wherein the annular flange has a bottom edge portion lying in a first transverse plane and the axially extending portion of the hood flange has a bottom edge lying in a second transverse plane when the hood is in a closed position and wherein the first and second transverse planes lie substantially in the same plane.

23. The system of claim 21 wherein the annular flange has a bottom edge portion lying in a first transverse plane and the axially extending portion of the hood flange has a bottom edge lying in a second transverse plane when the hood is in a closed position and wherein the first transverse plane lies above the second transverse plane.

24. The system of claim 21 further comprising a wear resistant nonmetallic material disposed on the axially extending portion of the hood flange.

25. The system of claim 21 wherein the cylinder has a perimeter length and wherein the hood covers from about 30 to about 60 percent of the perimeter length of the cylinder when the hood is in a closed position to form a seal.

26. The system of claim 21 wherein the length of the longitudinally extending portion of the hood flange is substantially uniform along the entire radial length of the hood flange.

27. The system of claim 21 wherein the length of the longitudinally extending portion of the hood flange varies along the radial length of the hood flange.

* * * * *